US010230181B2

(12) United States Patent
Krueger et al.

(10) Patent No.: US 10,230,181 B2
(45) Date of Patent: Mar. 12, 2019

(54) ALL-ANGLE GROUND CLAMPS

(71) Applicant: Hubbell Incorporated, Shelton, CT (US)

(72) Inventors: Teri Lynn Krueger, Columbia, MO (US); Lawrence Gerard Bereswill, Columbia, MO (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/006,409

(22) Filed: Jun. 12, 2018

(65) Prior Publication Data

US 2018/0358716 A1 Dec. 13, 2018

Related U.S. Application Data

(60) Provisional application No. 62/518,045, filed on Jun. 12, 2017.

(51) Int. Cl.
*H01R 4/64* (2006.01)
*H01R 11/24* (2006.01)
(Continued)

(52) U.S. Cl.
CPC ..... *H01R 4/64* (2013.01); *H01R 11/24* (2013.01); *H01R 11/26* (2013.01); *H01R 11/28* (2013.01)

(58) Field of Classification Search
CPC ..... H01R 4/64; H01R 4/366; H01R 4/5091; H01R 4/38; H01R 11/24; H01R 11/26
See application file for complete search history.

(56) References Cited

U.S. PATENT DOCUMENTS 1,862,073 A 6/1932 Woolson
1,864,651 A 6/1932 Hawley
(Continued)

FOREIGN PATENT DOCUMENTS

CN 104348122 A 2/2015
CN 104868403 A 8/2015

OTHER PUBLICATIONS

Salisbury Grade 5 All-Angle Clamps; Product Info. On 2.5" Aluminum Angle Clamps—Threaded—W/O Strain Relief System; retrieved from the Internet on or about Jun. 11, 2018, URL: https://www.salisburybyhoneywell.com/en/products/safetyline_grounding_equipment/grounding_clamps_flats_angles/2point5_aluminum_allangle_clamps; 1 page.
(Continued)

*Primary Examiner* — Jean F Duverne
(74) *Attorney, Agent, or Firm* — Verrill Dana, LLP; John W. Powell

(57) ABSTRACT

An all-angle ground clamp comprising a clamp body. There is a clamping mechanism affixed to an upper portion of the clamp body and which is removably attached to an electric conductor to be grounded. There is a terminal member having a mount portion releasably affixed to the base portion of the clamp body and a connector portion connected to an electrical ground conductor. The clamp body is rotatable relative to the terminal member about the mount portion is in a released position and is fixed relative to the terminal member when the mount portion is in a secured position. There is an electrical shunt having a first end connected to the clamping mechanism and a second end connected to the base portion of the clamp body for establishing a parallel electric path between the clamping mechanism and the base portion of the clamp body.

17 Claims, 10 Drawing Sheets

(51) Int. Cl.
*H01R 11/28* (2006.01)
*H01R 11/26* (2006.01)

(56) References Cited

U.S. PATENT DOCUMENTS

| | | | | |
|---|---|---|---|---|
| 2,137,840 | A | 2/1937 | Hayes | |
| 3,887,254 | A | 6/1975 | Landis | |
| 4,133,591 | A | 1/1979 | West et al. | |
| 4,911,572 | A * | 3/1990 | Williams | H01R 4/38 403/209 |
| 5,152,701 | A * | 10/1992 | Polidori | H01R 4/5091 403/396 |
| 5,547,404 | A * | 8/1996 | Nellis, Jr. | H01R 4/366 439/786 |
| 6,315,278 | B1 * | 11/2001 | Gaztanaga | B25B 5/12 269/228 |
| 8,317,536 | B2 | 11/2012 | Flojo | |
| 8,517,776 | B1 | 8/2013 | Flojo | |

OTHER PUBLICATIONS

Grounding Clamps for High and Extra High Voltage Systems; Terex Utilities Catalog online; retrieved from the Internet on Jun. 12, 2018; URL: http://terexutilities.com.br/products/maintenance-tools-electrical-systems/grounding-equipment-and-sectional-hot-stick/2-grounding-clamps-for-high-and-extra-high-voltage-systems/; 2 pageS.

Bierer Ground Clamps; Jumper/ Grounding Clamps; retrieved from the Internet on Jun. 12, 2018; URL: https://www.pierermeters.com/shop/grounds_jumpers/ground-clamps; 1 page.

RITZ TEREX GRADE 5; Grounding Clamps for Transmission Lines, High and Extra-High Voltage Substations; Product Information; retrieved from the Internet on or about Apr. 25, 2017; URL: http://www.terexutilities.com.br/produtos/ferramentas-manutencao-sistemas-eletricos/conjuntos-de-aterramento-e-varas-de-manobra/1-grampos-atr-para-uso-em-linhas-de-transmissao-e-subestacoes-de-alta-e-extra-alta-tensao/; 1 page.

CHANCE Utility C6001732; Internet catalog page from Hubbell.com website; retrieved from the Internet on Jun. 11, 2018; URL: https://www.hubbell.com/hubbell/en/OHW/Power-Utilities/Grounding-Bonding/Mechanical/Clamps/All-Angle/Ground-Clamp—All-Angle-I-B-5-2-88-Jaw-Opening/p/1647655; 2 pages.

CHANCE Utility G42291SJ; Internet catalog page from Hubbell.com website; retrieved from the Internet on Jun. 11, 2018; URL: https://www.hubbell.com/hubbell/en/OHW/Power-Utilities/Grounding-Bonding/Mechanical/Clamps/All-Angle/Ground-Clamp—All-Angle-I-B-5-1-196-Jaw-Opening/p/1647657; 2 pages.

CHANCE Utility G422810SJ; Internet catalog page from Hubbell.com website; retrieved from the Internet on Jun. 11, 2018; URL:https://www.hubbell.com/hubbell/en/OHW/Power-Utilities/Grounding-Bonding/Mechanical/Clamps/All-Angle/Ground-Clamp—All-Angle-I-B-5-2-88-Jaw-Opening/p/1647656; 2 pages.

CHANCE Utility HG422816SJ; Internet catalog page from Hubbell.com website; retrieved from the Internet on Jun. 11, 2018; URL: https://www.hubbell.com/hubbell/en/OHW/Power-Utilities/Grounding-Bonding/Mechanical/Clamps/All-Angle/Ground-Clamp—All-Angle-Mounted-6-II-B-5/p/1647658; 2 pages.

CHANCE Utility T6001693; Internet catalog page from Hubbell.com website; retrieved from the Internet on Jun. 11, 2018; URL: https://www.hubbell.com/hubbell/en/OHW/Power-Utilities/Grounding-Bonding/Mechanical/Clamps/All-Angle/Ground-Clamp—All-Angle-I-B-5-2-88-Jaw-Opening/p/1647660; 2 pages.

* cited by examiner

ALL-ANGLE GROUND CLAMPS

CROSS-REFERENCE TO RELATED APPLICATIONS

This application claims the benefit of priority to U.S. Provisional Application No. 62/518,045, filed Jun. 12, 2017, which is incorporated herein by reference.

FIELD OF THE INVENTION

The subject matter disclosed herein relates generally to all-angle ground clamps and more specifically to all-angle ground clamps for high voltage and high current levels.

BACKGROUND OF THE INVENTION

Temporarily grounding de-energized electrical circuits may help protect personnel working on such electrical circuits. The de-energized circuits can become inadvertently energized from induced voltage from adjacent energized lines, fault-current feed-over from adjacent lines, lightning strikes anywhere on the de-energized circuit, switching-equipment malfunction or human error, and accident-initiated contact with adjacent lines. Since any one of the above could result in re-energizing the de-energized electrical circuit, utilities may treat these potential dangers as ever-present and impose temporary-grounding work rules.

There are a number of types of ground clamps available, e.g. C-type grounding clamps, bus bar grounding clamps, snap-on or duckbill-type grounding clamps, and all-angle grounding clamps. All-angle grounding clamps can clamp to an electric line at many different angles providing greater flexability than other types of ground clamps. For high voltage and high current scenarios, clamps require low resistance to ensure proper grounding in the event of a short circuit fault. Since all-angle temporary ground clamps may rely on multiple components assembled in a manner that allows multiple degrees of freedom, each connection point may increase resistance.

For these and/or other considerations, all-angle temporary ground clamps may not be capable of withstanding fault currents at an ASTM Grade 5H level (Rated Current 47 kA with High Asymmetrical Requirement X/R=30 for 15 cycles, wherein the X/R is the ratio of reactance to resistance of the electrical impedance of a faulted (short) circuit from the source of fault current to the location of the fault on the circuit). Accordingly, an all-angle temporary ground clamp capable of withstanding fault currents at an ASTM Grade 5H level or higher may be desired in the field.

BRIEF DESCRIPTION OF THE INVENTION

The benefits and advantages of the present invention over existing all-angle ground clamps will be readily apparent from the Brief Summary of the Invention and Detailed Description to follow. One skilled in the art will appreciate that the present teachings can be practiced with embodiments other than those summarized or disclosed below.

In one embodiment there is an all-angle ground clamp, comprising a clamp body having a base portion and an upper portion. The clamping mechanism may be affixed to the upper portion of the clamp body and configured to be removably attached to an electric conductor to be grounded. There may be a terminal member having a mount portion releasably affixed to the base portion of the clamp body and a connector portion configured to be connected to an electrical conductor in electrical communication with ground. The clamp body may be rotatable relative to the terminal member when the mount portion is in a released position and may be fixed relative to the terminal member when the mount portion is in a secured position. The electrical shunt may have a first end connected to the clamping mechanism and a second end connected to the base portion of the clamp body for establishing a parallel electric path between the clamping mechanism and the base portion of the clamp body while enabling the clamp body to be rotated relative to the terminal member when the mount portion is in the released position.

In other aspects one or more of the following features may be included. The clamp body may be rotatable relative to the terminal member about 360 degrees when the mount portion is in the released position. The mount portion of the terminal member may include a pair of curved leg members extending from the connector portion of the terminal member and terminating in a pair of ends. The curved leg members may have opposing inner surfaces spaced from each other and defining a substantially circular shape and the ends may have opposing surfaces being in spaced relationship to each other. The mount portion may further include a connector which connects the ends of the mount portion, and the connector may be configured to be actuated to move the opposing surfaces of the ends towards and away from each to transition the mount portion between the released position and the secured position. The base portion of the clamp body may include a stud member extending therefrom and the inner surfaces of the mount portion of the terminal member engage with a circular external surface of the stud member to affix the clamp body to the terminal member. The circular external surface of the stud member may include a circular groove and wherein the connector includes a bolt which seats in the circular groove in which it is able to rotate when the mount portion is in the released position. The all-angle ground clamp may further include a relief slot positioned between the inner surfaces of the curved leg members to enable the connector, when actuated, to move the opposing surfaces of the ends towards each, to more firmly secure the inner surfaces of the curved leg members to the external surface of the stud member to reduce the electrical resistance between the clamp body and the terminal member. The electrical shunt may include at least two flexible electrical conductors each having a first end connected to the clamping mechanism and a second end connected to the base portion of the clamp body for establishing at least two parallel electric paths between the clamping mechanism and the base portion of the clamp body.

In yet further aspects one or more of the following features may be included. The clamping mechanism may include a first jaw member in opposing relation to a second jaw member, which first and second jaw members may be configured to be removably attached to the electric conductor to be grounded. The first jaw member may be a single jaw and the second jaw member may be a double jaw having a gap between the double jaws, and wherein the gap may be configured to receive the single jaw when the first and second jaw members are closed. The first end of one of the at least two flexible electrical conductors may be connected to a first side of the double jaws and the first end of another of the at least two flexible electrical conductors may be connected to a second side of the double jaws, opposite the first side. The clamp body may include a jaw retainer affixed to the upper portion of the clamp body, and wherein the first and second jaw members are pivotally mounted on the jaw retainer. The first jaw member may include a first clamping surface and a first spherical surface and the second jaw member may include a second clamping surface and a second spherical surface. The first jaw member may be pivotally mounted on the jaw retainer between the first clamping surface and the first spherical surface and second jaw member may be pivotally mounted on the jaw retainer between the second clamping surface and the second spherical surface. The all-angle ground clamp may further include a compression spring having a first end in contact with the first jaw member proximate the first clamping surface and a second end in contact with the second jaw member proximate the second clamping surface to bias the first and second clamping surfaces to pivot into an open position. When in the open position, the first and second spherical surfaces may be pivoted into contact with each other. There may be further included a conical actuator in contact with the first and second spherical surfaces to cause the spherical surfaces to separate when the conical actuator is moved in a first direction and, as a result, cause the first and second clamping surfaces to pivot toward a closed position. When the conical actuator is moved in a second direction, opposite the first direction, the spherical surfaces may move toward each other and, as a result, cause the first and second clamping surfaces to pivot toward the open position. The conical actuator may include a conical member affixed to an end of a bolt and the bolt may include threads which are mated to complementary threads on the surface of a bore through the base portion of the clamp body. The bolt may be configured to travel in the first and second directions through the bore by screw action as the bolt is rotated. The conical actuator may include a conical member affixed to an end of a ferrule member and the ferrule member may include threads which are mated to complementary threads on the surface of a bore through the base portion of the clamp body. The ferrule member may be configured to travel in the first and second directions through the bore by screw action as the ferrule member is rotated.

BRIEF DESCRIPTION OF THE FIGURES

Embodiments of the present disclosure will now be described, by way of example only, with reference to the attached Figures, wherein.

DETAILED DESCRIPTION OF THE INVENTION

Described herein is an all-angle ground clamp which may be used as a temporary protective measure and which may be capable of withstanding fault currents at an ASTM Grade 5H level or higher. The ground clamp may be used to ground various types of electrical conductors, including but not limited to electric lines, cables, and busses and as used herein the term electrical conductors will encompass all of the foregoing. Such fault currents experienced by the ground clamp herein may be up to at least 47 KA with a high asymmetrical requirement X/R=30 for 15 cycles where X/R is the ratio of reactance to resistance of a faulted (short) circuit from the source of fault current to the location of the fault on the circuit. The voltage levels for the electric conductors to which these ground clamps would typically be connected may nominally operate at 15 KV or higher; however, the ground clamp may also used with lower voltage conductors which have significant fault currents.

Multiple embodiments and variations of all-angle ground clamps are described and illustrated herein. In some embodiments, an all-angle ground clamp can include one or more flexible shunt(s) to assist in carrying the high fault currents from the clamping jaws to the clamp body while still allowing for full rotation of the clamp body relative to the terminal member to which is attached a grounding conductor. The flexible shunts may reduce the resistance of the ground clamp by providing direct contact from the jaws to the main terminal body, thus circumventing the multiple contact joints.

Figure 1A:
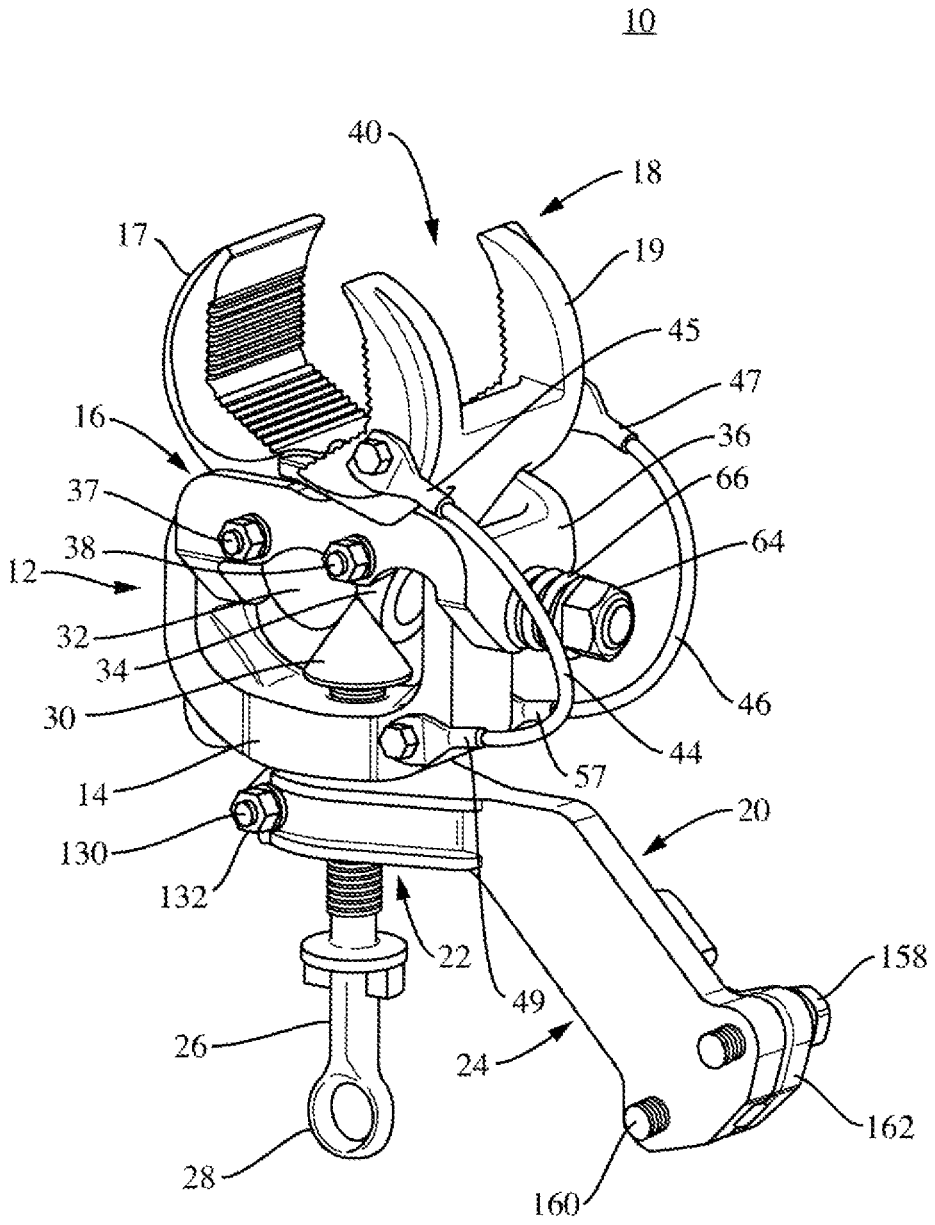
FIG. 1A shows a perspective view of an all-angle ground clamp according to an embodiment of the invention.
Figure 1B:
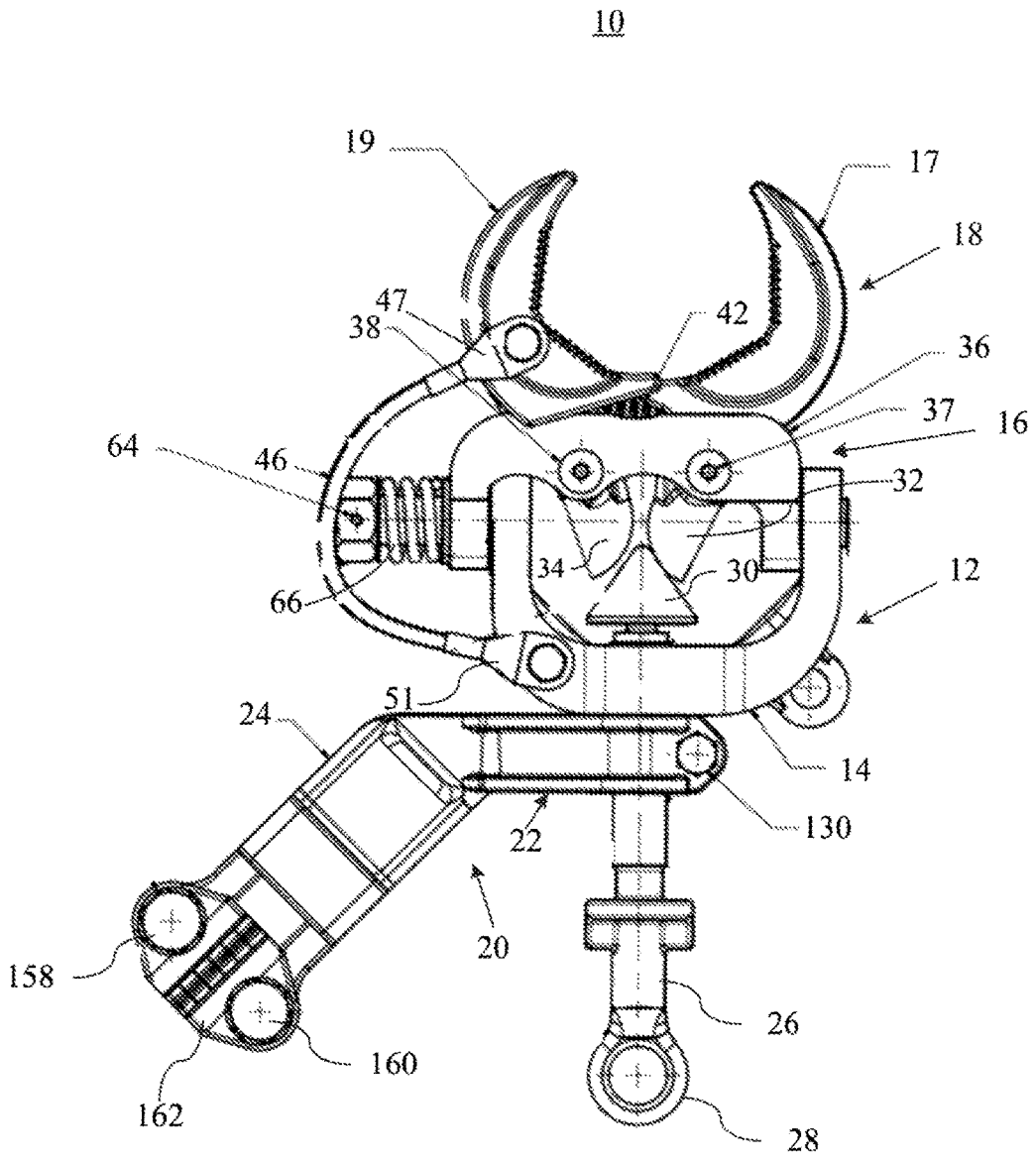
FIG. 1B shows a side elevational view of the all-angle ground clamp of FIG. 1A.

With reference to FIGS. 1A and 1B, in some embodiments an all-angle ground clamp 10 comprises a clamp body 12 having a base portion 14 and an upper portion 16. There is a clamping mechanism 18, including single-jaw 17 and double-jaw 19, affixed to the upper portion 16 of clamp body 12 and in opposing relation to each other. Single-jaw 17 and double-jaw 19 may be securely attached to a de-energized high voltage/current electric conductor (not shown) by closing the jaws tightly on the conductor and then removed by releasing the jaws, as described below.

There is a terminal member 20 having a mount portion 22, which is releasably affixed to clamp body 12. Terminal member 20 also has a connector portion 24 to be connected to an electrical grounding conductor (not shown), which grounding conductor is in electrical communication with ground. Clamp body 12 is rotatable relative to the terminal member 20 when the mount portion 22 is in a released position and is fixed relative to the terminal member when the mount portion is in a secured position, as described below. In a preferred embodiment, the terminal member 20 may rotate about the mount portion 22 a full 360 degrees. The clamp body 12 and terminal member 20 rotate relative to each other about the longitudinal axis of bolt 26, which is threaded through apertures in the terminal member 20 and the base 14 of clamp body 12.

In this and other embodiments, there may be a bolt 26 such as an eyebolt with eye 28 at a first end of bolt 26 and a cone 30 at the opposite end of the bolt 26. As the eyebolt 26 is rotated clockwise it advances in a direction toward spherical surfaces 32 and 34 of jaws 17 and 19, respectively, which causes the cone 30 to impart force on the spherical surfaces 32 and 34. Jaws 17 and 19 are pivotally mounted on jaw retainer 36 by bolts 37 and 38, respectively, thus the force imparted by cone 30 on spherical surfaces 32 and 34 causes them to separate when the force of the compression spring 42 biasing the jaws in the open position is overcome. This in turn causes jaws 17 and 19 to move in a direction toward each other toward a closed position. Bolt 26 may be rotated by using a hot line tool, such as a "grip all" clamp stick, which may be inserted into eye 28 and then used to rotate bolt 26.

As the bolt 26 is further turned in the clockwise direction, jaws 17 and 19 continue to close until they have been sufficiently clamped onto an electrical conductor to be grounded. As the jaws come together, single-jaw 17 can nest within cavity 40 between double-jaw 19 so that the jaws may be tightened further to accommodate smaller diameter electric conductors. As the eyebolt 26 is rotated in the opposite direction (counter-clockwise) it moves in a direction away from spherical surfaces 32 and 34 of jaws 17 and 19, respectively. As it moves away, the force imparted on the spherical surfaces 32 and 34 by cone 30 is reduced and compression spring 42 connected between jaws 17 and 19 forces the jaws toward the open position.

An electrical shunt is formed by flexible conductors 44 and 46, which are connected from first ends 45/47 affixed to opposite sides of double-jaw 19, to the base portion 14 of clamp body 12 by second ends 49/51. In this embodiment, the conductors may be made of copper and have a diameter of 5/16 in. Of course, the conductors may be formed of aluminum or other material and may have different diameters depending in the application, which will be apparent to those skilled in the art. By establishing a parallel electric path between the jaws of the clamping mechanism and the base portion of the clamp body (rather than directly to terminal member 20), the flexible conductors can rotate with the clamp body and thus enable the clamp body to be rotated relative to the terminal member, preferably about a full 360 degrees, when the mount portion is in the released position. The flexible conductors reduce the resistance of the ground clamp by providing direct contact from the jaws to the main terminal body, thus circumventing the multiple contact joints.

Figure 1C:
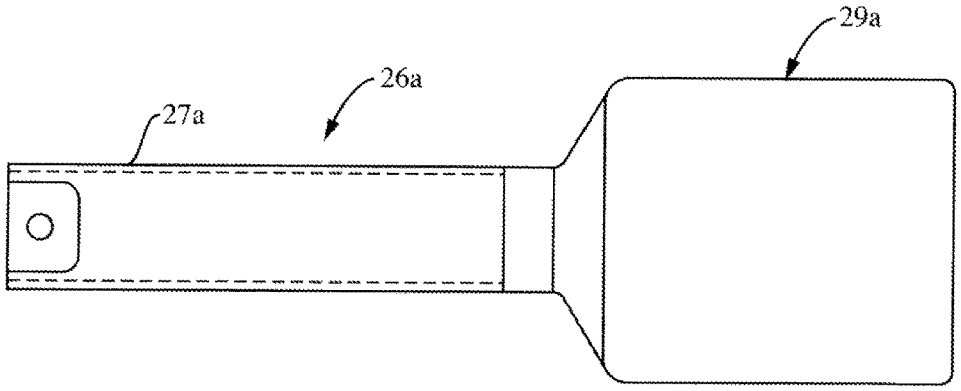
FIG. 1C shows a side elevational view of a ferrule member which may be used in place of the eye-bolt in the all-angle ground clamp of FIG. 1A.

In an alternative embodiment, bolt 26 may be replaced with a ferrule member 26*a*, as shown in FIG. 1C. Ferrule member 26*a* includes a first portion 27*a* having external threads and having an outer diameter sized so that it may be threaded through mount portion 22 of terminal member 20 and base 14 of clamp body 12 in the same manner as bolt 26 shown in FIGS. 1A and 1B. Although not shown, cone 30 would be placed on the end of first portion 27*a*. There is a second portion 29*a*, with a wider diameter than the diameter of first portion 27*a* and having a hollowed out end in which may be inserted and affixed thereto a hot line tool for allowing an operator to rotate ferrule member 26*a* to open and close jaws 17 and 19.

Figure 2A:
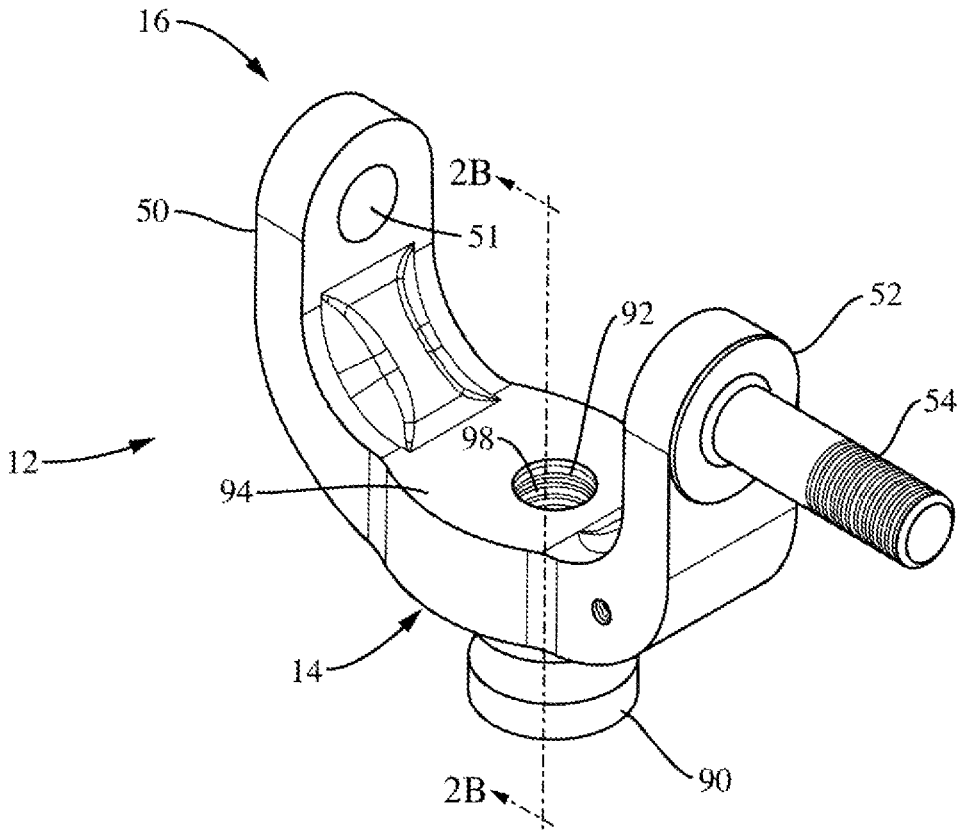
FIG. 2A shows a perspective view of the clamp body of the all-angle ground clamp of FIG. 1A.
Figure 2B:
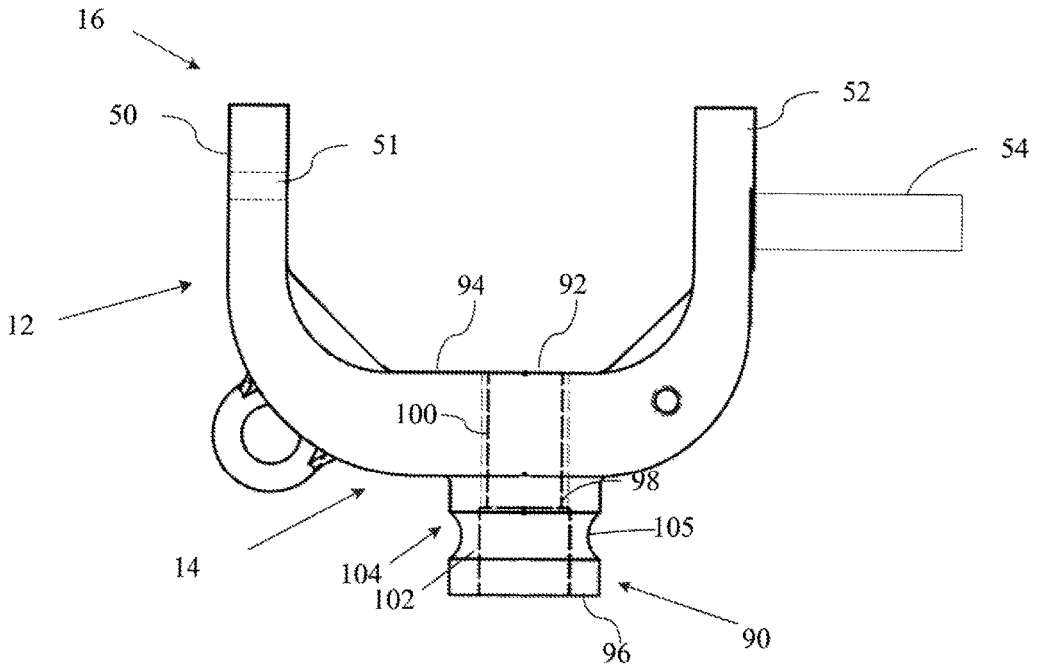
FIG. 2B shows a cross-sectional view of the clamp body of FIG. 2A.
Figure 4A:
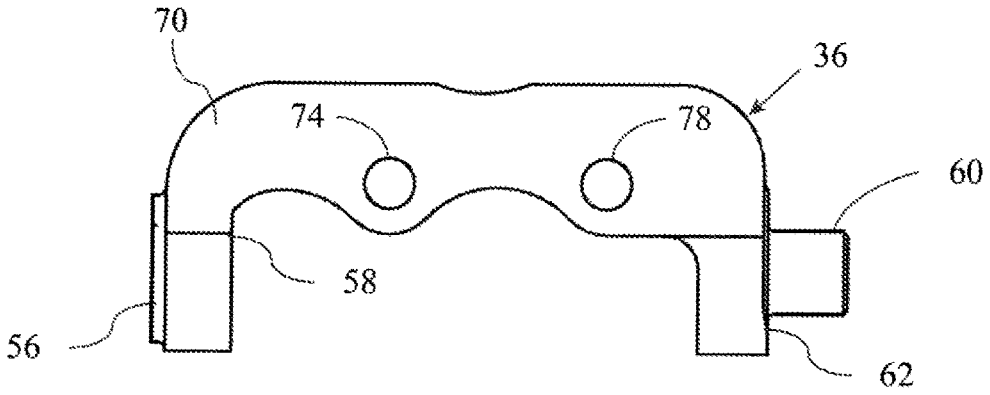
FIG. 4A a side elevational view of the retaining jaw of the all-angle ground clamp of FIG. 1A.
Figure 4B:
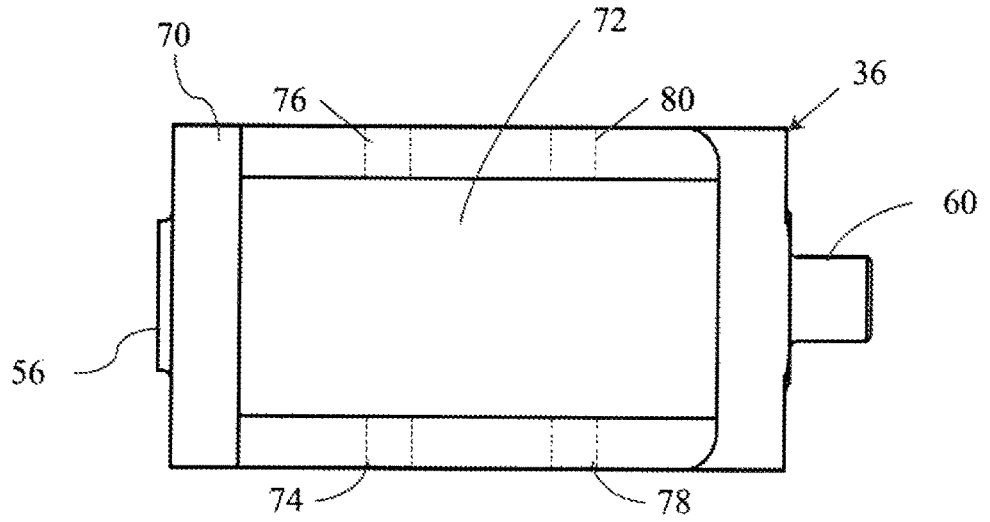
FIG. 4B shows a top plan view of the retaining jaw of FIG. 4A.

Referring now to FIGS. 2A and 2B, clamp body 12 is shown in more detail. Clamp body 12 in this embodiment is U-shaped and includes legs 50 and 52 extending up from base 14 and terminating at upper portion 16. Near the top of leg 50 is hole 51 extending through leg 51 from the exterior to the interior of clamp body 12. On the other leg 52 is an integrated threaded bolt member 54 extending from leg 52 to the exterior of clamp body 12. Jaw retainer 36 (FIGS. 4A and 4B) is affixed to the upper portion 16 of the clamp body 12 by inserting bolt member 54 on the outside of clamp body 12 through hole 56 in leg 58 of jaw retainer 36, as shown in FIGS. 1A and 1B. On the opposite end of jaw retainer 36 is a stud member 60 extending out from leg 62, which is inserted into hole 54 in leg 50 of clamp body 12. The jaw retainer 36 may be rotatably secured onto clamp body 12 by nut 64 and compression spring 66 so that it may be rotated approximately 180 degrees about the longitudinal axis of bolt member 54.

Referring again to FIGS. 4A and 4B, jaw retainer 36 includes a retainer body 70 in which is disposed a rectangular aperture 72. Single-jaw 17 and double jaw 19 are disposed in aperture 72, as shown in FIGS. 1A and 1B, by being pivotally mounted on the jaw retainer 36 by bolts 37 and 38 which pass through holes 74/76 and 78/80, respectively.

Referring again to FIGS. 2A and 2B, the base portion 14 of the clamp body 12 includes a stud member 90 extending therefrom. There is a cylindrical through-hole 92 which extends from base surface 94 of clamp body 12 to opening 96 at the bottom of stud member 90. Through-hole 92 is configured to receive eye bolt 26 which engages with threads 98 on the inner surface of its upper portion 100. In the lower portion 102 of through-hole 92 the inner wall is not threaded. In addition, the diameter of lower portion 102 is slightly larger than the diameter of upper portion 100, so as to make insertion of eye-bolt 26 into the clamp body easier.

Figure 3A:
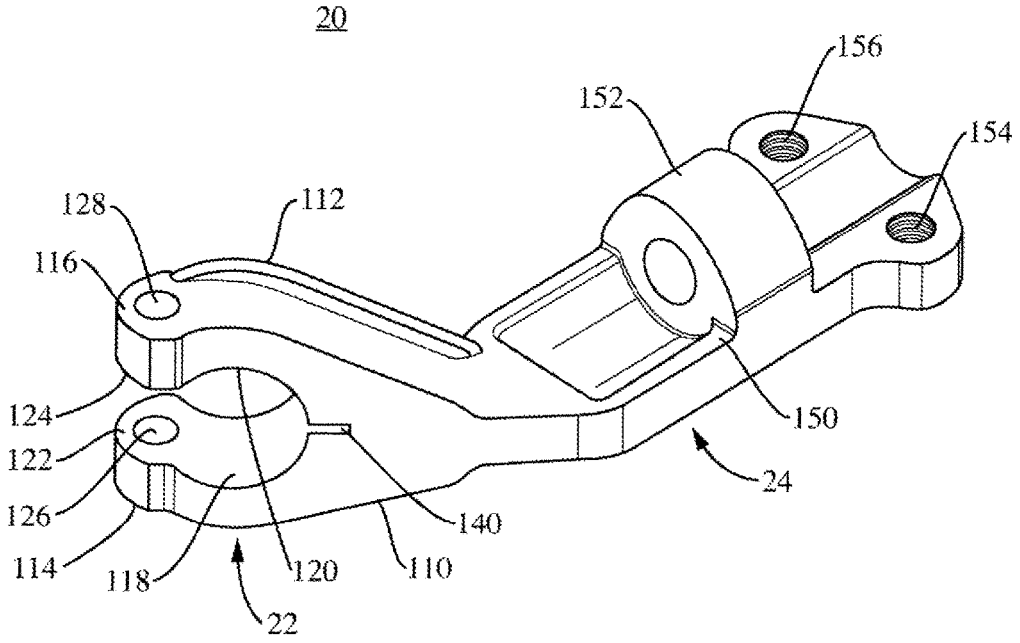
FIG. 3A shows a perspective view of the terminal member of the all-angle ground clamp of FIG. 1A.
Figure 3B:
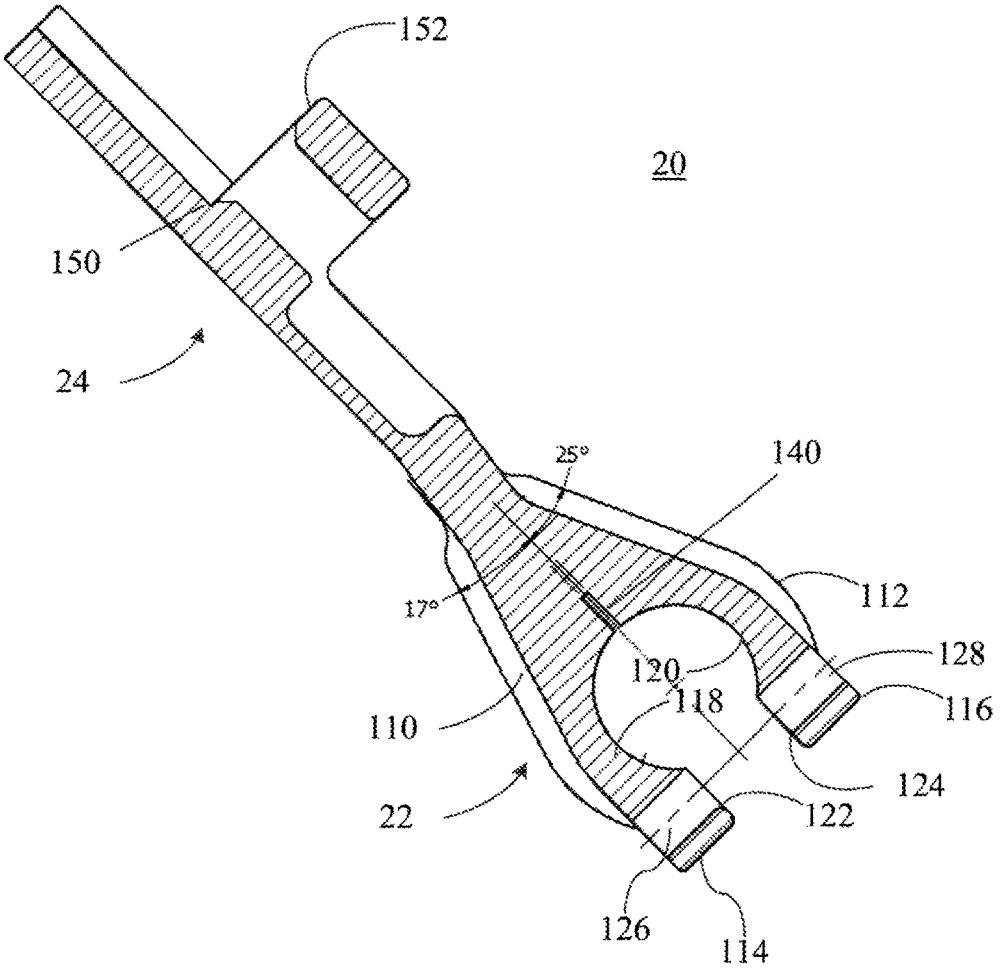
FIG. 3B shows a cross-sectional view of the terminal member of FIG. 3A.

Terminal member 20, FIGS. 3A and 3B, includes a mount portion 22 which is affixed to the circular exterior surface 104 of stud member 90 (see FIGS. 2B and 1A/1B). In exterior surface 104 is included a circular groove 105 to help facilitate rotation of clamp body 12 about terminal member 20, as described below. The mount portion 22 of the terminal member 20 includes a pair of curved leg members 110 and 112 extending from the connector portion 24 of the terminal member 20 and terminating in a pair of end members 114 and 116. The curved leg members 110 and 112 have opposing, curved inner surfaces 118 and 120, respectively, which are spaced from each other and define a substantially circular shape. The end members 114 and 116 have opposing surfaces 122 and 124, respectively, which are in spaced relationship to each other and which have aligned through holes 126 and 128 for receiving a connector, such as a bolt. Bolt 130 is shown in FIGS. 1A and 1B and is secured by nut 132.

As the connector is actuated (i.e. the bolt 130 and nut 132 combination are tightened) opposing surfaces 122 and 124 of the end members 126 and 128 are moved closer together curved inner surfaces 118 and 120 are tightened around exterior surface 104 of stud member 90. Once tightened, the mount portion 22 of terminal member 20 is affixed to stud member 90 of clamp body 12 in a secured position. In order to ensure a snug fit between the inner surfaces 118 and 120 of curved leg members 110 and 112 against the exterior surface 104 of stud member 90, bolt 130 is positioned in circular groove 105. The circular groove 105 also holds the bolt 130 in place when bolt 130 and nut 132 are loosened and in a released position. This enables the rotation of clamp body 12 relative to terminal member 20 by bolt 130 being secured in place in circular groove 105 but being loose enough to move therein.

As indicated above, the electrical shunt established by the flexible conductors 44 and 46 between the jaws 17 and 19 of the clamping mechanism 18 and the base portion 14 of the clamp body 12 enable the clamp body to be rotated relative to terminal member 20 about a full 360 degrees while reducing the resistance of the ground clamp by providing direct contact from the jaws to the main terminal body. However, by not having the electrical shunt directly connected to the terminal member 20, a fault current flow may still exist from the base 14 of the clamp body 20 to the mount portion 22 of the terminal member 20. As such, a very strong mechanical connection between the inner surfaces 118/120 of the mount portion 22 and the exterior surface 104 of the stud member of the clamp body must be established. This enables the components to maintain good mechanical contact even when significant forces are imparted during a fault. By staying in good mechanical contact, the electrical resistance between the components remains low and hence good electrical conduction during a fault is maintained.

To achieve such a strong mechanical connection and reduced resistance, a relief slot 140 is machined into the mount portion 20 between inner surfaces 118 and 120 of the curved leg members 110 and 112. In this embodiment, the relief slot may be approximately 0.38 in long by 0.07 in width. This enables the bolt 130, when tightened sufficiently (i.e. to approximately 250 in-lbs), to move the opposing surfaces 122 and 124 of the end members 114 and 116 more closely towards each other, which more firmly secures the inner surfaces 118 and 120 of the curved leg members 110 and 112 to the external surface 104 of the stud member 90. This lowers the electrical resistance and promotes better electrical communication between the clamp body 12 and the terminal member 20. The electrical resistance between the terminal member 20 and the jaws 17 and 19 with the shunts and the relief slot may be reduced to approximately 0.13 ohm from approximately 0.5 ohm without the shunts and the relief slot.

Continuing to refer to FIGS. 3A and 3B, terminal member 20 also has a connector portion 24 configured to be connected to an electrical grounding conductor (not shown), which conductor is in electrical communication with ground. Connector portion 24 includes a terminal pad 150 on which the electrical grounding conductor is placed and threaded through circular retainer 152 to hold it in position on pad 150. Threaded holes 154 and 156 are included to receive screws 158 and 160, respectively, from a terminal cap 162 (FIGS. 1A and 1B) to securely connect the electrical grounding conductor to the terminal pad 150.

Figure 5A:
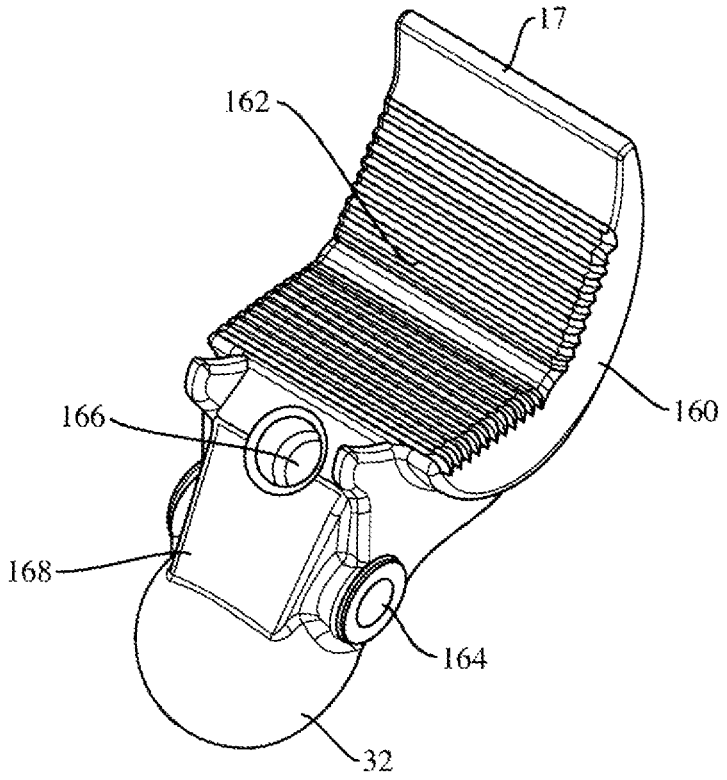
FIG. 5A shows a perspective view of the single-jaw of the clamping mechanism of the all-angle ground clamp of FIG. 1A.
Figure 5B:
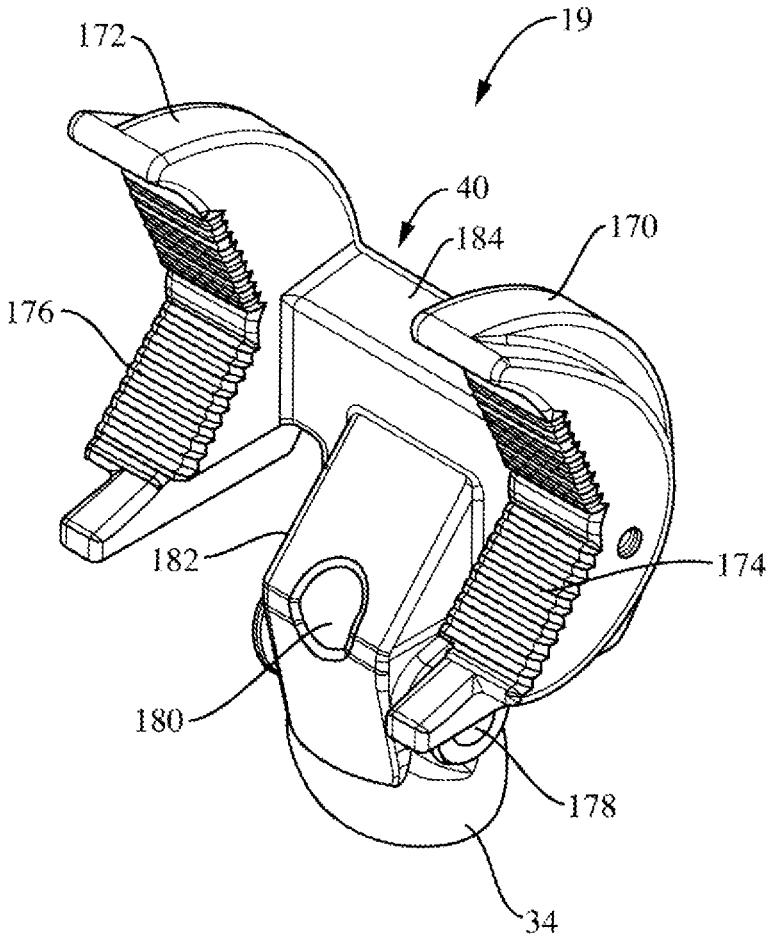
FIG. 5B shows a perspective view of the double-jaw of the clamping mechanism of the all-angle ground clamp of FIG. 1A.

Referring now to FIGS. 5A, single-jaw clamp 17 in shown in more detail to include a curved jaw 160 with a serrated clamping surface 162. There is also a spherical surface 32 which engages with cone 30 affixed to eye-bolt 26, FIGS. 1A and 1B, to cause single-jaw clamp 17 to pivot about bolt 37 which passes through through-hole 164. Aperture 166 in jaw base 168 receives a first end of the compression spring 42 which biases the single-jaw 17 in the open position. Referring now to FIGS. 5B, double-jaw clamp 19 comprises first and second curved jaws 170 and 172 each having a serrated clamping surface 174 and 176, respectively. There is also a spherical surface 34 which engages with cone 30 affixed to eye-bolt 26, FIGS. 1A and 1B, to cause double-jaw clamp 19 to pivot about bolt 38 which passes through through-hole 178. Aperture 180 in jaw base 182 receives the other end of compression spring 42 which biases the double-jaw 19 in the open position. Member 184, connected to jaw base 182, has first and second curved jaws 172 and 174 mounted to either end thereof, between which is defined cavity 40 for receiving single-jaw clamp 17 when the jaws are closed on smaller sized conductors. This particular jaw configuration allows the ground clamp to accommodate a wide range of conductor sizes. In a preferred embodiment the grip range is from about 0.25 in. to 2.8 in.

It should be noted that the components of the all-angle ground clamp herein may be formed of aluminum, such as A356T6 aluminum, however, the clamp body and the bolt/ferrule member may be formed of a bronze alloy, such as CDA87610 bronze, to provide increased mechanical strength and lower resistance.

While the foregoing description enables one of ordinary skill to make and use what is considered presently to be the best mode of the all-angle ground clamp, those of ordinary skill will understand and appreciate the existence of variations, combinations, and equivalents of the specific embodiments and examples herein. The above-described embodiments of the present invention are intended to be examples only. Alterations, modifications and variations may be effected to the particular embodiments by those of skill in the art without departing from the scope of the invention, which is defined solely by the claims appended hereto.

The invention is therefore not limited by the above described embodiments and examples, embodiments, and applications within the scope and spirit of the invention claimed as follows.

We claim:

1. An all-angle ground clamp, comprising:

a clamp body having a base portion and an upper portion;

a clamping mechanism affixed to the upper portion of the clamp body and configured to be removably attached to an electric conductor to be grounded;

a terminal member having a mount portion releasably affixed to the base portion of the clamp body and a connector portion configured to be connected to an electrical conductor in electrical communication with ground; wherein the clamp body is rotatable relative to the terminal member when the mount portion is in a released position and is fixed relative to the terminal member when the mount portion is in a secured position; and an electrical shunt having a first end connected to the clamping mechanism and a second end connected to the base portion of the clamp body for establishing a parallel electric path between the clamping mechanism and the base portion of the clamp body while enabling the clamp body to be rotated relative to the terminal member when the mount portion is in the released position.

2. The all-angle ground clamp of claim 1 wherein the clamp body is rotatable relative to the terminal member about 360 degrees when the mount portion is in the released position.

3. The all-angle ground clamp of claim 1, wherein the mount portion of the terminal member includes a pair of curved leg members extending from the connector portion of the terminal member and terminating in a pair of ends; the curved leg members having opposing inner surfaces spaced from each other and defining a substantially circular shape; the ends having opposing surfaces being in spaced relationship to each other.

4. The all-angle ground clamp of claim 3, wherein the mount portion further includes a connector which connects the ends of the mount portion, and wherein the connector is configured to be actuated to move the opposing surfaces of the ends towards and away from each to transition the mount portion between the released position and the secured position.

5. The all-angle ground clamp of claim 4, wherein the base portion of the clamp body includes a stud member extending therefrom and the inner surfaces of the mount portion of the terminal member engage with a circular external surface of the stud member to affix the clamp body to the terminal member.

6. The all-angle ground clamp of claim 5, wherein the circular external surface of the stud member includes a circular groove and wherein the connector includes a bolt which seats in the circular groove in which it is able to rotate when the mount portion is in the released position.

7. The all-angle ground clamp of claim 5, further including a relief slot positioned between the inner surfaces of the curved leg members to enable the connector, when actuated to move the opposing surfaces of the ends towards each other, to more firmly secure the inner surfaces of the curved leg members to the external surface of the stud member to reduce the electrical resistance between the clamp body and the terminal member.

8. The all-angle ground clamp of claim 1, wherein the electrical shunt includes at least two flexible electrical conductors each having a first end connected to the clamping mechanism and a second end connected to the base portion of the clamp body for establishing at least two parallel electric paths between the clamping mechanism and the base portion of the clamp body.

9. The all-angle ground clamp of claim 8, wherein the clamping mechanism includes a first jaw member in opposing relation to a second jaw member, which first and second jaw members are configured to be removably attached to the electric conductor to be grounded.

10. The all-angle ground clamp of claim 9, wherein the first jaw member is a single jaw and the second jaw member is a double jaw having a gap between the double jaws, and wherein the gap is configured to receive the single jaw when the first and second jaw members are closed.

11. The all-angle ground clamp of claim 10, wherein the first end of one of the at least two flexible electrical conductors is connected to a first side of the double jaws and the first end of another of the at least two flexible electrical conductors is connected to a second side of the double jaws, opposite the first side.

12. The all-angle ground clamp of claim 9, wherein the clamp body includes a jaw retainer affixed to the upper portion of the clamp body, and wherein the first and second jaw members are pivotally mounted on the jaw retainer.

13. The all-angle ground clamp of claim 12, wherein the first jaw member includes a first clamping surface and a first spherical surface and the second jaw member includes a second clamping surface and a second spherical surface; and wherein the first jaw member is pivotally mounted on the jaw retainer between the first clamping surface and the first spherical surface and second jaw member is pivotally mounted on the jaw retainer between the second clamping surface and the second spherical surface.

14. The all-angle ground clamp of claim 13, further including a compression spring having a first end in contact with the first jaw member proximate the first clamping surface and a second end in contact with the second jaw member proximate the second clamping surface to bias the first and second clamping surfaces to pivot into an open position; wherein, when in the open position, the first and second spherical surfaces are pivoted into contact with each other.

15. The all-angle ground clamp of claim 14, further including a conical actuator in contact with the first and second spherical surfaces to cause the spherical surfaces to separate when the conical actuator is moved in a first direction and, as a result, cause the first and second clamping surfaces to pivot toward a closed position; and when the conical actuator is moved in a second direction, opposite the first direction, the spherical surfaces move toward each other and, as a result, cause the first and second clamping surfaces to pivot toward the open position.

16. The all-angle ground clamp of claim 15, wherein the conical actuator includes a conical member affixed to an end of a bolt; and wherein the bolt includes threads which are mated to complementary threads on the surface of a bore through the base portion of the clamp body; the bolt is configured to travel in the first and second directions through the bore by screw action as the bolt is rotated.

17. The all-angle ground clamp of claim 15, wherein the conical actuator includes a conical member affixed to an end of a ferrule member; and wherein the ferrule member includes threads which are mated to complementary threads on the surface of a bore through the base portion of the clamp body; the ferrule member is configured to travel in the first and second directions through the bore by screw action as the ferrule member is rotated.

* * * * *